US008146645B2

(12) United States Patent
Pulcini et al.

(10) Patent No.: US 8,146,645 B2
(45) Date of Patent: Apr. 3, 2012

(54) SYSTEM AND PROCESS FOR MANUFACTURING FRAMELESS WINDOWS

(75) Inventors: Sergio Pulcini, Volpiano TO (IT); Christoph Senge, Dillingen (DE)

(73) Assignees: Pilkington Automotive Deutschland GmbH, Witten (DE); Pilkington Italia S.p.A., San Salvo (Chieti) (IT)

( * ) Notice: Subject to any disclaimer, the term of this patent is extended or adjusted under 35 U.S.C. 154(b) by 308 days.

(21) Appl. No.: 12/519,705

(22) PCT Filed: Dec. 19, 2007

(86) PCT No.: PCT/EP2007/064187

§ 371 (c)(1),
(2), (4) Date: Jun. 17, 2009

(87) PCT Pub. No.: WO2008/074822

PCT Pub. Date: Jun. 26, 2008

(65) Prior Publication Data

US 2010/0038010 A1 Feb. 18, 2010

(30) Foreign Application Priority Data

Dec. 19, 2006 (EP) ..... 06425848

(51) Int. Cl.
*B23P 11/00* (2006.01)

(52) U.S. Cl. ..... 156/538; 156/66; 296/200; 296/146.1; 296/146.15; 296/84.1; 29/281.1; 269/289 R

(58) Field of Classification Search ..... 296/200, 296/146.1, 146.15, 84.1; 269/289 R; 29/281.1; 156/66, 538
See application file for complete search history.

(56) References Cited

U.S. PATENT DOCUMENTS

| | | | | |
|---|---|---|---|---|
| 3,832,274 | A | 8/1974 | Owston | |
| 4,026,088 | A | 5/1977 | Akabane | |
| 4,803,257 | A | 2/1989 | Goel | |
| 4,987,699 | A | 1/1991 | Gold | |
| 5,546,704 | A | 8/1996 | Maruoka | |
| 5,987,820 | A | 11/1999 | Shibanushi | |
| 6,247,218 | B1 * | 6/2001 | Saunus et al. | 29/434 |

(Continued)

FOREIGN PATENT DOCUMENTS

DE 3932724 A1 4/1991

(Continued)

OTHER PUBLICATIONS

Form PCT/ISA/210 (International Search Report) dated Apr. 18, 2008.

(Continued)

*Primary Examiner* — Jeff Aftergut
*Assistant Examiner* — Jaeyun Lee
(74) *Attorney, Agent, or Firm* — Buchanan Ingersoll & Rooney PC

(57) ABSTRACT

System for manufacturing frameless windows which comprise a transparent pane, the lower edge of which is fixed in the slot of one or more holders by at least one layer of adhesive, which system comprises a work-table suitable for supporting the pane with the lower edge turned upwards and one or more mobile supports suitable for moving downwards the holders toward the pane, so that the holders can be inserted astride the lower edge, turned upwards, of the pane. In addition, a process is disclosed which can be carried out with the system.

20 Claims, 6 Drawing Sheets

U.S. PATENT DOCUMENTS

| | | | |
|---|---|---|---|
| 6,349,504 | B1 | 2/2002 | Schmitt |
| 6,425,207 | B1 | 7/2002 | Davis |
| 6,729,073 | B2 | 5/2004 | Nicolai |
| 6,966,149 | B2 | 11/2005 | Fenelon |
| 2003/0056458 | A1 | 3/2003 | Black et al. |
| 2006/0032175 | A1 | 2/2006 | Chen et al. |
| 2006/0048452 | A1 | 3/2006 | Sweeney et al. |
| 2010/0037543 | A1 | 2/2010 | Pulcini et al. |

FOREIGN PATENT DOCUMENTS

| | | | |
|---|---|---|---|
| DE | 4203364 | A1 | 8/1993 |
| DE | 4336107 | A1 | 4/1995 |
| DE | 43 40 363 | A1 | 6/1995 |
| DE | 19728580 | A1 | 1/1998 |
| DE | 19902059 | A1 | 6/1999 |
| DE | 19808916 | A1 | 9/1999 |
| DE | 10044845 | A1 | 4/2002 |
| DE | 10049768 | A1 | 4/2002 |
| DE | 10 2004 015 052 | A1 | 10/2005 |
| DE | 102004015052 | A1 | 10/2005 |
| EP | 0 173 091 | A2 | 3/1986 |
| EP | 0173091 | A2 | 3/1986 |
| EP | 0878336 | A2 | 11/1998 |
| EP | 1123858 | A1 | 8/2001 |
| EP | 1239016 | A1 | 9/2002 |
| EP | 1403108 | A1 | 3/2004 |
| EP | 1617028 | A1 | 1/2006 |
| FR | 2 762 350 | A1 | 10/1998 |
| WO | WO 99/31396 | A1 | 6/1999 |
| WO | WO 01/98613 | A2 | 12/2001 |
| WO | WO 2004/016894 | A2 | 2/2004 |

OTHER PUBLICATIONS

European Search Report dated May 25, 2007 issued in the corresponding European Patent Application No. 06 42 5845.

European Search Report dated Jun. 27, 2007 issued in the corresponding European Patent Application No. 06 42 5846.

* cited by examiner

SYSTEM AND PROCESS FOR MANUFACTURING FRAMELESS WINDOWS

The present invention relates to a system for manufacturing frameless windows, in particular mobile windows for motor vehicles. The present invention also relates to a process which can be carried out with said system.

WO 01/98613 discloses a process and an apparatus for manufacturing frameless windows which comprise a glass pane, the lower edge of which is fixed by means of adhesives in the slot of one or more holders. These windows, already provided with said holders, are arranged onto a work-table in a substantially horizontal position. A portion of these holders is removed when the windows lie on the work-table, so as to compensate the shape variations of the glass pane with respect to its nominal shape. These shape variations can also be compensated by slightly modifying the mutual position of the pane with respect to the holders by exploiting the minimum gap which is comprised in the slot between the pane and the holders for applying the adhesives between them.

Similar windows and manufacturing arrangements are also disclosed in DE 4340363, FR 2762350 and WO 2004/016894.

However, in all the above mentioned known windows, the possibility of compensating the shape variations of the glass pane is very low since the high precision and the short manufacturing times required for mounting the window do not allow to employ holders with relatively wide slots.

It is therefore an object of the present invention to manufacture frameless windows by compensating in a simple and fast manner their shape variations with respect to the nominal shape. Said object is achieved with a system and a process, the main features of which are disclosed in claims 1 and 17, respectively, while other features are disclosed in the remaining claims.

Thanks to the particular arrangement of the work-table and of the mobile supports of a first apparatus thereof, the system according to the present invention allows to arrange in the correct position the holders with respect to the pane and to easily and quickly apply in the ends of the slots of the holders a layer of a first adhesive having a high elastic modulus and a short cure time. After the application of the first adhesive, the slots can be filled with a second adhesive which completes the structural union between the pane and the holders in a particular second apparatus which allows to store the panes during the curing of the second adhesive. This second adhesive can have a lower elastic modulus and a longer cure time, since it can be applied when the holders are already fixed to the pane. Therefore, the system according to the present invention allows to manufacture the windows in two distinct steps, so as to optimize the manufacturing times and costs.

The viscosity of the second adhesive is preferably lower than the viscosity of the first adhesive, so as to simplify the application of the second adhesive, since the latter can be poured in a liquid form in the slots of the holders without leaking, because it is contained laterally by the layers of the first adhesive already cured.

Further advantages and features of the system and the process according to the present invention will become clear to those skilled in the art from the following detailed and non-limiting description of an embodiment thereof with reference to the attached drawings, wherein.

Figure 1:
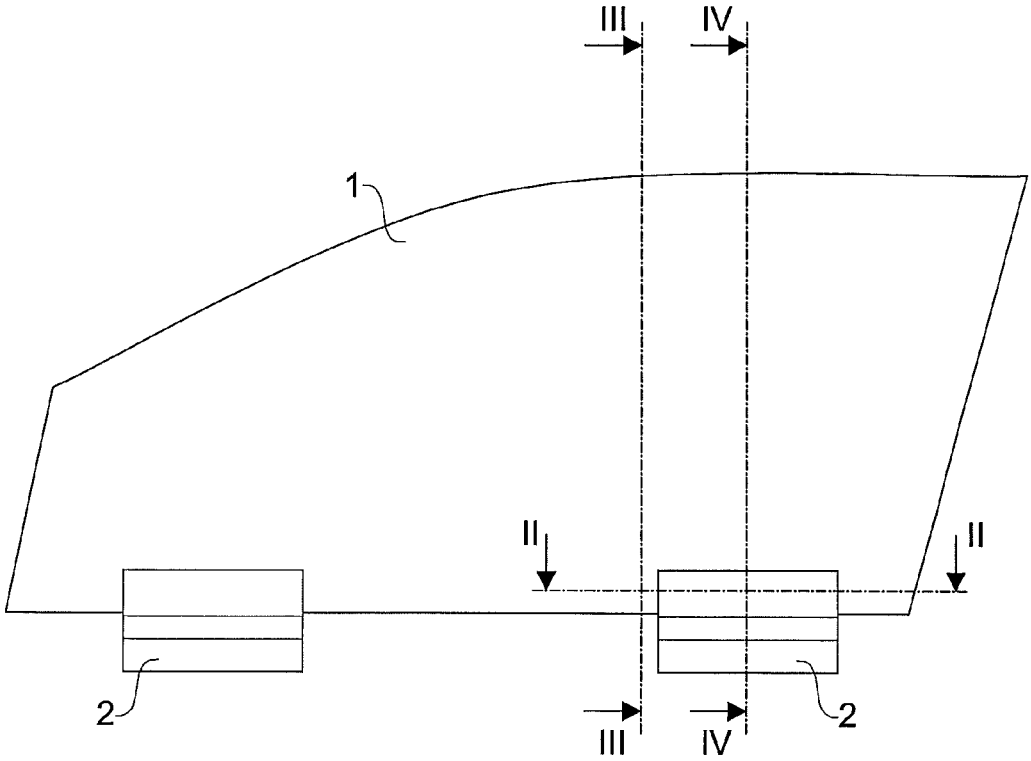
FIG. 1 shows a side view of the window.

Referring to FIG. 1, it is seen that the frameless window according to the present invention comprises in a known way a transparent pane, in particular a glass pane 1, generally bent inwards, the lower edge of which is inserted in the slot of one or more holders 2 which are suitable for supporting pane 1 and are provided with coupling members (not shown in the figures) for the mechanical connection to lifting devices, for example arranged in the door of a motor vehicle.

Figure 2:
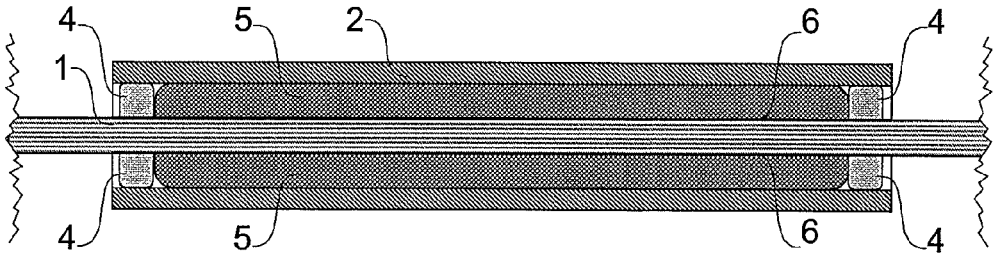
FIG. 2 shows an enlarged view sectioned along plane II-II of FIG. 1.
Figure 3:
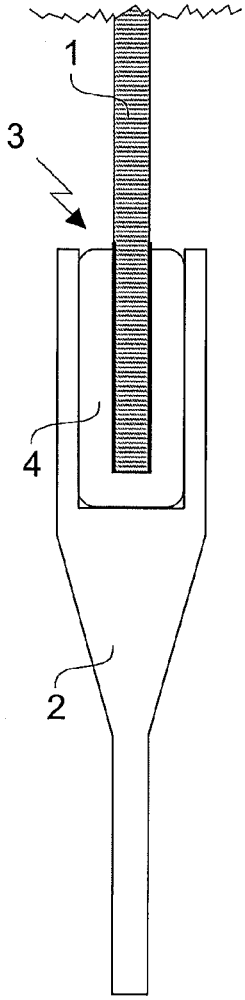
FIG. 3 shows an enlarged view sectioned along plane III-III of FIG. 1.
Figure 4:
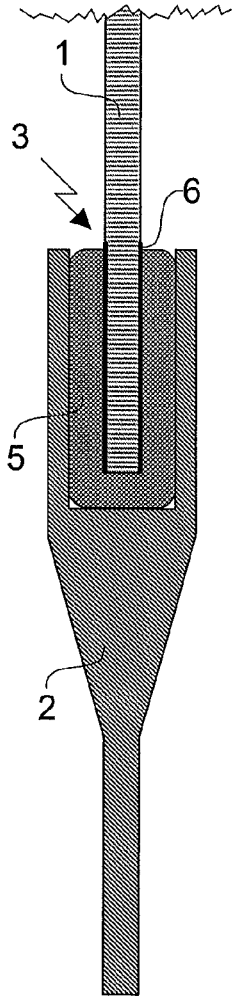
FIG. 4 shows an enlarged view sectioned along plane IV-IV of FIG. 1.

Referring to FIGS. 2 to 4, it is seen that the lower edge of pane 1 is separated from the walls of slot 3 of holders 2 and is joined thereto by means of one or more layers of a first adhesive 4 applied close to the lateral ends of slot 3, wherein at least one layer of a second adhesive 5 is applied in slot 3 between the layers of the first adhesive 4. A layer of primer 6 can be applied on the two faces of the lower edge of pane 1 before applying the layers of adhesive 4 and 5.

The first adhesive 4 is a hotmelt polyurethane adhesive, while the second adhesive 5 is a two-component polyurethane adhesive which can be applied at room temperature. The viscosity and the elastic modulus of the first adhesive 4 are higher than the viscosity and the elastic modulus, respectively, of the second adhesive 5, while the cure time of the first adhesive 4 is shorter than the cure time of the second adhesive 5.

Figure 5:
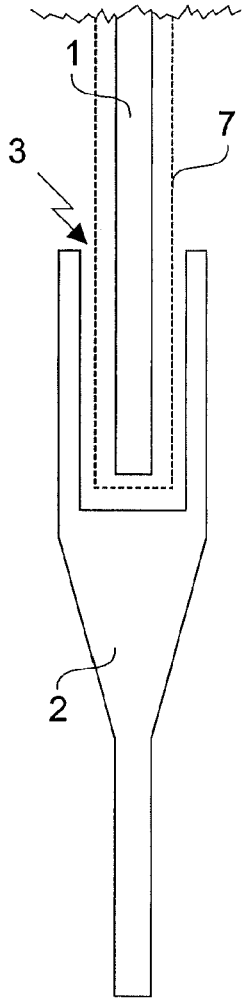
FIG. 5 shows a schematic view of the window of FIG. 4.

Referring to FIG. 5, it is seen that the width of slots 3 of holders 2 is at least twice the thickness of pane 1, so that the latter can be arranged in a variable position within a tolerance zone 7 (shown with broken lines) separated and distant from the inner walls of slots 3. In particular, with a pane 1 having a thickness comprised between 3 and 6 mm, the average width of the tolerance zone 7 is comprised between 6 and 10 mm, while the average width of slot 3 is comprised between 8 and 14 mm. The tolerance zone 7 further includes 1 mm of space downwards, while the average distance between the lower border of the tolerance zone 7 and the bottom of slot 3 is comprised between 1 and 3 mm. The depth of slot 3 is greater than 10 mm, in particular comprised between 31 and 33 mm.

Figure 6:
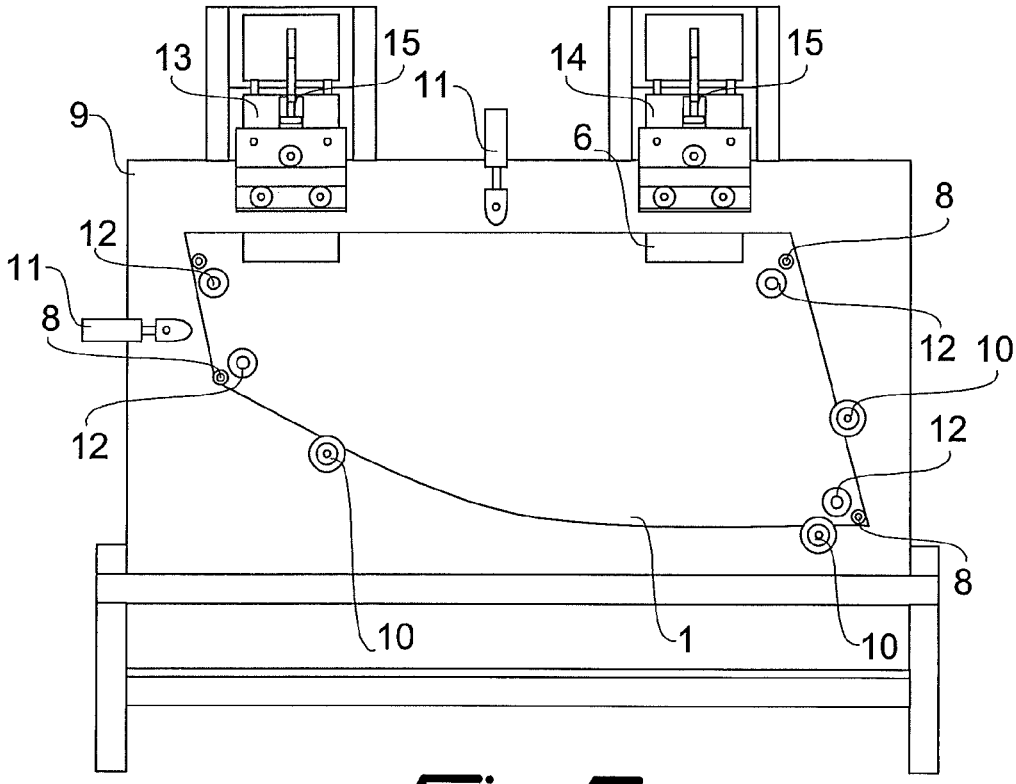
FIG. 6 shows a view perpendicular to the work-table of the first apparatus during a first operating step of the process.
Figure 7:
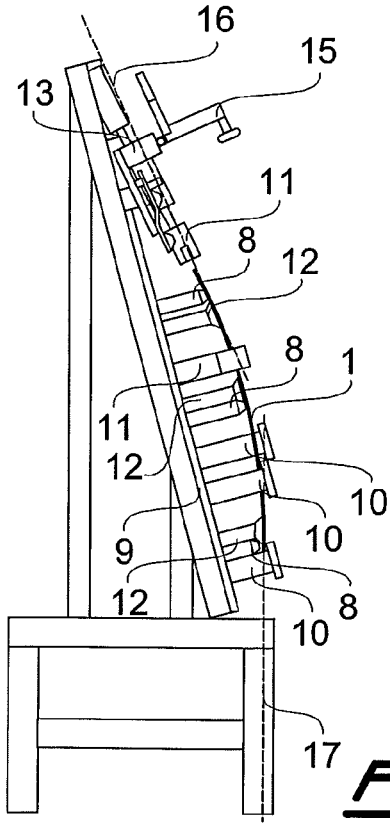
FIG. 7 shows a side view of the apparatus of FIG. 6.

Referring to FIGS. 6 and 7, it is seen that in a first operating step of the process according to the present invention, pane 1, already provided with primer 6, is arranged in a vertical or inclined position with the lower edge turned upwards on the first apparatus of the system according to the present invention, which comprises in a known way a plurality of reference supports 8 arranged on a work-table 9. The ends of these reference supports 8 contacting pane 1 are arranged in determined points which are in the same position in space of reference points employed for mounting the window in a motor vehicle. In particular, four reference supports 8 are arranged on work-table 9 in positions corresponding to the four corners of pane 1. The work-table 9 comprises a plurality of rollers 10 which contain laterally or support from the bottom the edges of pane 1. One or more pushers 11 are mounted on work-table 9 for urging pane 1 against rollers 10. In particular, a first pusher 11 is arranged on the upper portion of work-table 9 and a second pusher 11 is arranged on one side of work-table 9. A plurality of suction caps 12 are mounted on work-table 9 for pulling pane 1 against the reference supports 8. Two mobile supports 13, 14 are arranged on the upper portion of work-table 9 for moving holders 2 toward the lower edge, turned upwards, of pane 1. The mobile supports 13, 14 are also provided with a plurality of reference supports and with a lever vice 15 for locking in a determined position holders 2 on these reference supports. The mobile supports 13, 14 can be driven by pneumatic pistons along a plane 16 tangent to the lower edge, turned upwards, of pane 1, which plane 16 forms an angle lower than 20° with work-table 9. Work-table 9 is inclined so that a plane 17 tangent to the upper edge turned downwards of pane 1 forms an angle lower than 30°, in particular lower than 5°, with a vertical plane. Work-table 9 forms in turn an angle lower than 30° with a vertical plane.

Figure 8:
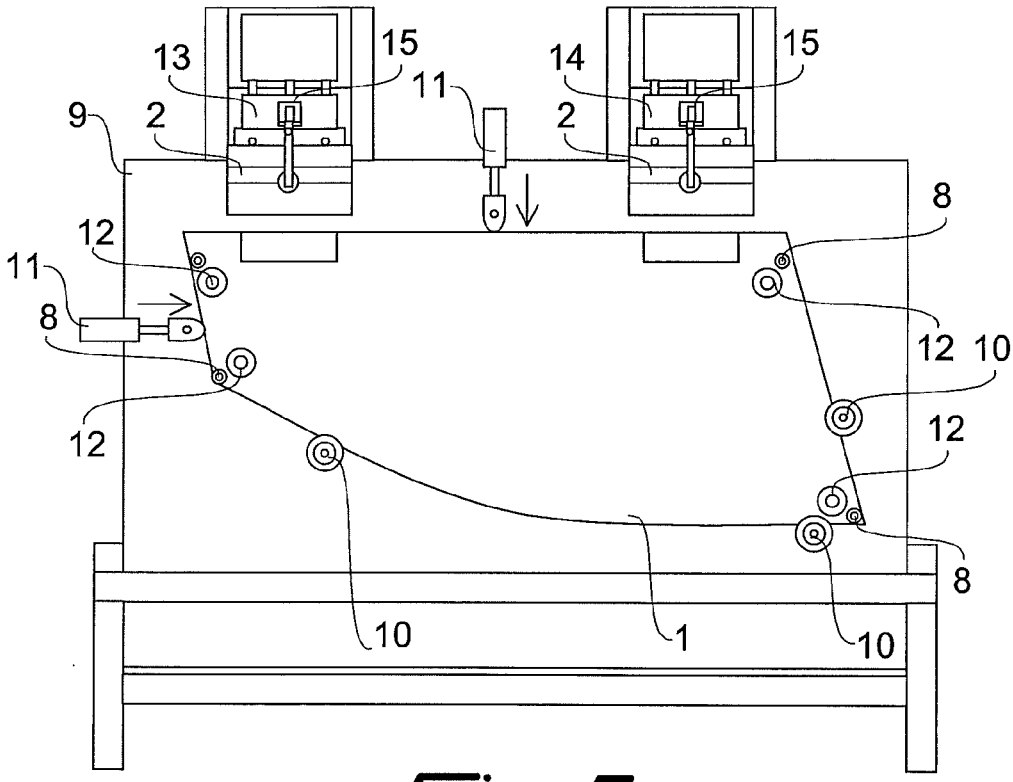
FIG. 8 shows a view perpendicular to the work-table of the first apparatus during a second operating step of the process.
Figure 9:
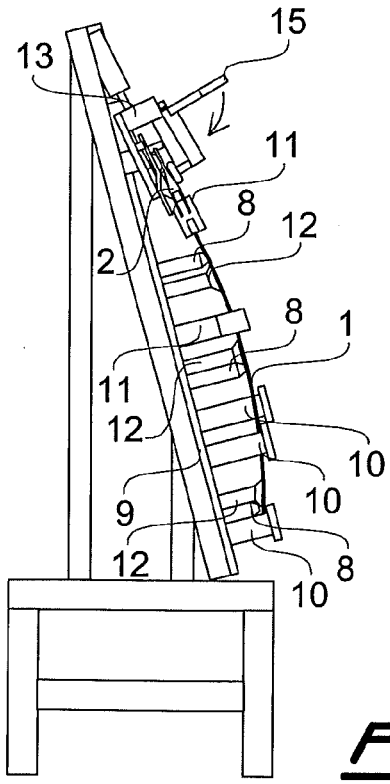
FIG. 9 shows a side view of the apparatus of FIG. 8.

Referring to FIGS. 8 and 9, it is seen that in a second operating step of the process according to the present invention pane 1 is locked by pushers 11 and by suction cups 12 on work-table 9, while holders 2 are locked on the mobile supports 13, 14 by the lever vices 15.

Figure 10:
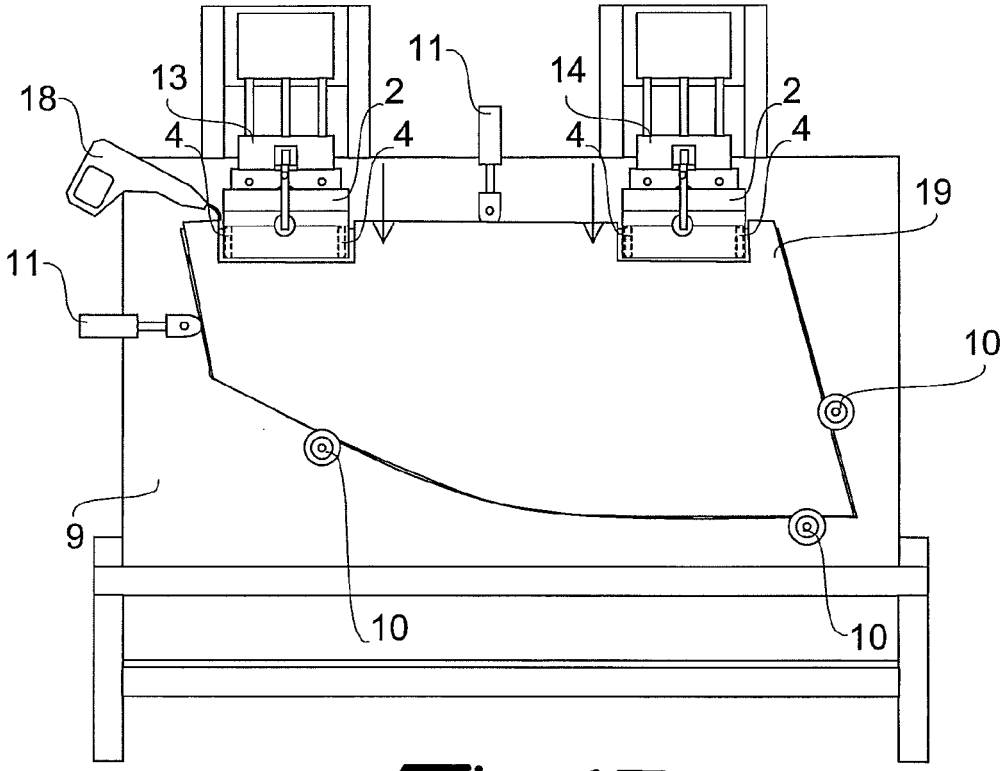
FIG. 10 shows a view perpendicular to the work-table of the first apparatus during a third operating step of the process.
Figure 11:
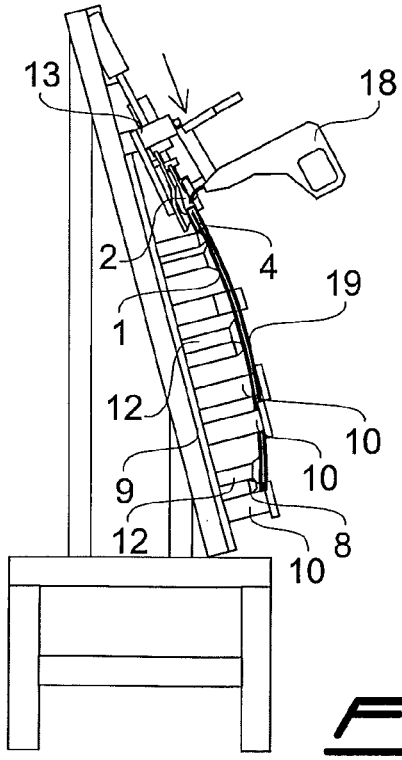
FIG. 11 shows a side view of the apparatus of FIG. 10.

Referring to FIGS. 10 and 11, it is seen that in a third operating step of the process according to the present invention holders 2 are moved downwards toward pane 1 by the mobile supports 13, 14, so that holders 2 are inserted astride the lower edge of pane 1, after which the layers of the first adhesive 4 (shown with broken lines in FIG. 10), heated at a temperature comprised between 110 and 130° C., are applied to the lateral ends of slots 3 of holders 2 by means of a heating applicator 18 provided with a curved nozzle, so as to easily reach the edges of slots 3 arranged behind pane 1. A protective screen 19 suitable to cover pane 1, thereby leaving holders 2 uncovered, is arranged onto pane 1 before the application of the first adhesive 4. When the first adhesive 4 has reached a suitable cure time, i.e. when the first adhesive 4 can firmly support holders 2 in their position with respect to pane 1, the lever vices 15 are opened, the mobile supports 13, 14 are lifted, screen 19 is removed and pane 1 is separated from work-table 9.

Figure 12:
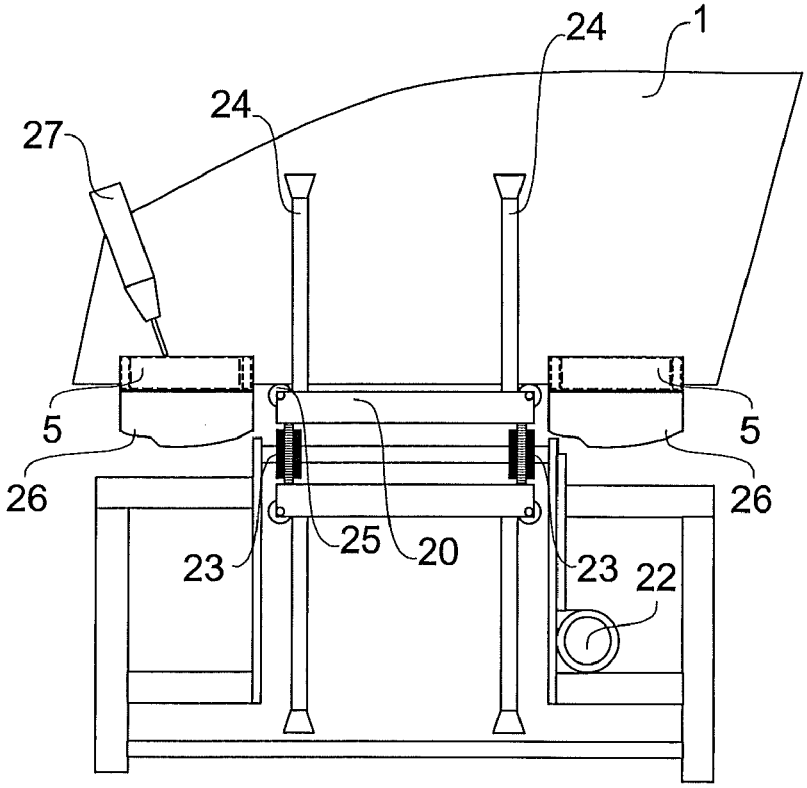
FIG. 12 shows a front view of the second apparatus during a fourth operating step of the process.
Figure 13:
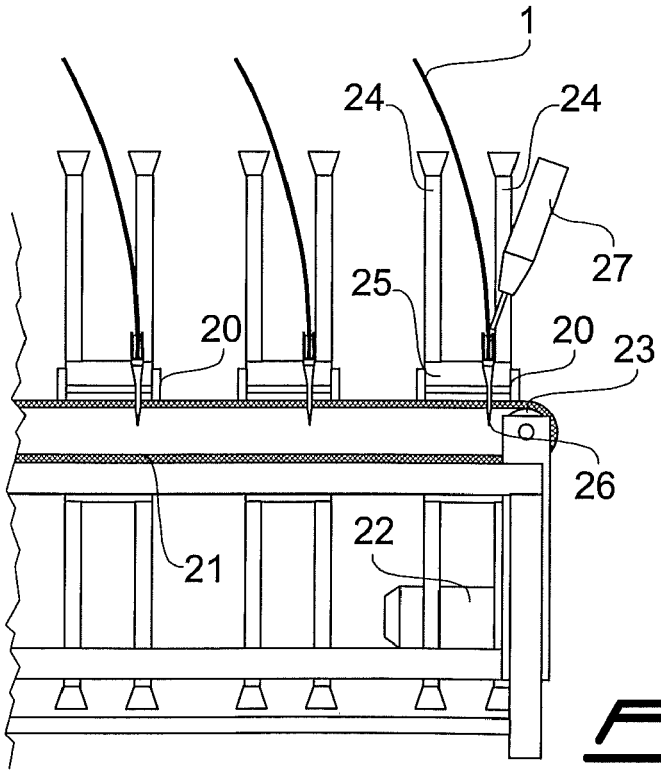
FIG. 13 shows a partial side view of the apparatus of FIG. 12.

Referring to FIGS. 12 and 13, it is seen that in a fourth operating step of the process according to the present invention pane 1 provided with holders 2 is arranged with the lower edge turned downwards on a carriage 20 of the second apparatus of the system according to the present invention, which comprises a series of carriages 20 suitable for moving horizontally in a direction substantially perpendicular to pane 1. For this purpose, carriages 20 are fixed to a conveying device comprising one or more chains 21 driven by an electric motor 22 by means of toothed wheels 23, so that a first half of carriages 20 can run in a longitudinal direction, while the second half of carriages 20 runs under the first half in the opposite direction. Each carriage 20 comprises a plurality of vertical supports 24, for example two pairs of bars, between which one pane 1 is arranged. Each carriage 20 also comprises a plurality of rollers 25 which support pane 1, thereby allowing a transversal sliding thereof with respect to carriage 20. The vertical supports 24 are arranged between the holders 2 fixed to pane 1. A protective sheath 26, for example a rubber glove, is put on holders 2, after which a mixing applicator 27 pours from the top the second adhesive 5 (shown with broken lines in FIG. 12) into slot 3 of holders 2 of pane 1 on the first carriage 20 arranged at the beginning of the series of carriages, until slot 3 is filled with the second adhesive 5, which is contained laterally in slot 3 by the two layers of the first adhesive 4 arranged at the lateral ends of slot 3. At the end of the application of the second adhesive 5, carriage 20 is moved longitudinally, so that a free carriage is arranged at the beginning of the series for receiving a new pane.

The invention claimed is:

1. System for manufacturing frameless windows which comprise a transparent pane having a lower edge fixed in a plurality of holders by at least one layer of adhesive, wherein said system comprises a work-table suitable for supporting the pane with the lower edge turned upwards and a plurality of mobile supports, each one of said plurality of mobile supports suitable for independently moving downwards a corresponding one of the holders toward the pane, so that the holders can be inserted astride the lower edge, turned upwards, of the pane.

2. System according to claim 1, wherein a plurality of suction cups are mounted on the work-table for pulling the pane toward reference supports contacting the pane.

3. System according to claim 1, wherein the work-table comprises a plurality of rollers which contain laterally or support from the bottom the edges of the pane, wherein one or more pushers are mounted on the work-table for urging the pane against the rollers.

4. System according to claim 3, wherein a first pusher is arranged on the upper portion of the work-table for urging the pane downwards.

5. System according to claim 3, wherein a second pusher is arranged on one side of the work-table for urging the pane toward the opposite side.

6. System according to claim 1, wherein the mobile supports can be driven along a plane tangent to the lower edge, turned upwards, of the pane, said plane forming an angle lower than 20° with the work-table.

7. System according to claim 1, wherein the work-table is inclined so that a plane tangent to the upper edge turned downwards of the pane forms an angle lower than 30° , in particular lower than 5° , with a vertical plane.

8. System according to claim 1, wherein the work-table forms an angle lower than 30° with a vertical plane.

9. System according to claim 1, wherein it comprises a heating applicator for applying a layer of adhesive in the slot of the holders.

10. System according to claim 1, wherein it comprises a series of carriages suitable for supporting a pane and for moving horizontally in a direction substantially perpendicular to the pane.

11. System according to claim 10, wherein the carriages are fixed to a conveying device, so that a first half of carriages can run in a longitudinal direction, while the second half of carriages runs under the first half in the opposite direction.

12. System according to claim 10, wherein the carriages comprise a plurality of vertical supports, between which the pane is arranged, wherein the vertical supports are arranged between the holders fixed to the pane.

13. System according to claim 10, wherein the carriages comprise a plurality of rollers which support the pane, thereby allowing a transversal sliding thereof with respect to the carriages.

14. System according to claim 1, wherein it comprises a mixing applicator for applying a layer of adhesive in the slot of the holders.

15. Process for manufacturing frameless windows which comprise a transparent pane having a lower edge fixed in a slot of one or more holders by at least one layer of adhesive, the process comprising:

arranging the pane on a work-table with the lower edge of the pane turned upwards;

arranging the holders on one or more mobile supports suitable for moving the holders toward the pane;

moving downwards the mobile supports toward the pane, so that the holders are inserted astride the lower edge, turned upwards, of the pane; and applying one or more layers of adhesive in the slot of the holders.

16. Process according to claim 15, wherein one or more layers of a first adhesive and at least one layer of a second adhesive are applied in the slot of the holders.

17. Process according to claim 15, wherein a plurality of suction cups mounted on the work-table pull the pane toward reference supports contacting the pane during the application of a layer of a first adhesive.

18. Process according to claim 15, wherein one or more pushers mounted on the work-table urge the pane against a plurality of rollers which contain laterally or support from the bottom the edges of the pane during the application of a layer of a first adhesive.

19. Process according to claim 15, wherein the mobile supports are driven along a plane tangent to the lower edge, turned upwards, of the pane, said plane forming an angle lower than 20° with the work-table.

20. Process according to claim 15, wherein the lower edge of the pane is turned downwards when a layer of a second adhesive is applied in the slot of the holders.

* * * * *